United States Patent [19]

Fukumoto et al.

[11] Patent Number: 5,001,683

[45] Date of Patent: Mar. 19, 1991

[54] INTER-PULSE TIME DIFFERENCE MEASURING CIRCUIT

[75] Inventors: Harutugu Fukumoto; Muneaki Matsumoto, both of Okazaki; Yoshikazu Mizuno, Aichi, all of Japan

[73] Assignees: Nippondenso Co., Ltd., Kariya; Nippon Soken, Inc., Nishio, both of Japan

[21] Appl. No.: 518,448

[22] Filed: May 7, 1990

[30] Foreign Application Priority Data

May 12, 1989 [JP] Japan ..... 1-119267

[51] Int. Cl.[5] ..... G04F 1/00; G04F 10/00

[52] U.S. Cl. ..... 368/113; 368/118

[58] Field of Search ..... 368/113-121; 307/517, 603; 364/69

[56] References Cited

U.S. PATENT DOCUMENTS

| | | | |
|---|---|---|---|
| 3,564,284 | 2/1971 | Kamens | 307/232 |
| 3,582,678 | 8/1971 | Davis, Jr. | 307/234 |
| 3,731,195 | 5/1973 | Wessel | 368/118 |
| 3,961,258 | 6/1976 | Morisaki | 368/118 |
| 3,983,481 | 9/1976 | Nutt et al. | 368/118 |
| 4,002,979 | 1/1977 | Giori et al. | 368/118 |
| 4,339,712 | 7/1982 | Walters | 368/118 |
| 4,408,895 | 10/1983 | Geesen | 368/118 |
| 4,504,155 | 3/1985 | Ruggieri | 368/121 |

*Primary Examiner*—Vit W. Miska

*Attorney, Agent, or Firm*—Cushman, Darby & Cushman

[57] ABSTRACT

An inter-pulse time difference measuring circuit which expands the time difference between a first pulse and a second pulse by a given multiplication factor and measures the expanded time difference, thereby realizing a higher measuring resolution. The circuit can be constructed by using a capacitor charging and discharging circuit connected to a constant current source and such circuit can always expand the time difference by a given multiplication factor even if the voltages and resistance values of the other circuits than the constant current circuit are varied with temperature changes. The circuit can also be realized by a circuit which charges and discharges a capacitor through a pair of transistors having a given current ratio and such circuit can maintain the current ratio of the transistors constant without suffering the effect of temperature changes, thereby always ensuring expansion of the time difference between pulses by a given multiplication factor.

13 Claims, 4 Drawing Sheets

INTER-PULSE TIME DIFFERENCE MEASURING CIRCUIT

BACKGROUND OF THE INVENTION

1. Field of the Invention

The present invention relates to a circuit for measuring the inter-pulse time difference between a first pulse and a second pulse and more particularly to a circuit which can be effectively used in an apparatus which measures the distance to a target based on the delay time between the emission of a pulsed laser light and the reception of its reflected light.

2. Description of the Related Art

In the past, as shown for example in JP-A-59-203975, there has been proposed a vehicle optical radar system of the type in which a beam-like light signal is transmitted substantially parallel to a road surface to detect the distance to an object based on the propagation delay time which is required for receiving the reflected light signal from the object, and the system has been so designed that the direction of travel of the beam-like light signal is rotated parallel to the road surface so as to extend the maximum detection distance and to prevent the missing of a preceding vehicle at a curve in a road.

In the vehicle optical radar system of the above type, a distance detecting circuit includes an R-S flip-flop which is set by a beam-like light signal or transmitted signal and which is reset by a received signal, a high-frequency oscillator for generating a high-frequency pulse train, an AND gate for receiving the output of the R-S flip-flop and the output of the high-frequency oscillator, and a high-speed counter for counting the number of pulses in the high-frequency pulse train supplied through the AND gate. Then, in response to the output from the R-S flip-flop, the AND gate is opened for the period of the time difference between the transmitted signal and the received signal (the porpagation delay time) thereby supplying the high-frequency pulse train to the high-speed counter, whereby the high-speed counter generates calculated value of the distance corresponding to the time difference.

Then, where the distance is computed from the propergation delay time of the beam-like light signal as in the case of the above-mentioned conventional circuit, the following relation holds:

$$T>2L/C \text{(C:light velocity)}$$

where T represents the propagation delay time and L represents the distance. From the above equation, the propagation delay time T per meter of the distance L becomes 6.67 ns so that in order to obtain a resolution of 1 m for the detection distance, the oscillation frequency of the high-frequency oscilaltor must be set to 150 MHz. Also, since the high-speed counter must measure such an extremely high frequency, it is necessary to use a counter including an expensive ECL (emitter coupled logic) or the like. Further, while the resolution of the detected distance can be enhanced further by simply increasing the oscilaltion frequency, it is impossible to increase the oscillation frequency infinitely and therefore there is naturally a limitation to the resolution of the detected distance.

For instance, when constructing a physical quantity measuring apparatus in which a physical quantity e.g., a distance is converted to a corresponding time and the physical quantity is measured in accordance with the converted time, it is desired to construct an inter-pulse time difference measuring circuit designed so that the time corresponding to a physical quantity is expanded by a given multiplication factor and the physical quantity is computed from the expanded time, thereby obtaining an arbitrary detection resolution.

SUMMARY OF THE INVENTION

It is a first object of the present invention to provide an inter-pulse time difference measuring circuit including a constant-current charging and discharging circuit whereby even if the voltages, resistance and other factors, of the circuit are varied with temperature, etc., the pulse width of a pulse can be expanded or stretched by a given multiplication factor.

It is a second object of the present invention to provide an inter-pulse time difference measuring circuit making use of the fact that transistors can accurately distribute current with a current ratio of 1 to n (n is an integer not less than 1), even if the circuit resistance, etc., are varied with temperature, the current distribution ratio is not varied and the pulse width is expanded by a given multiplication factor.

It is a third object of the present invention to provide an inter-pulse time difference measuring circuit in which a capacitor is charged and discharged with a constant current to make the terminal voltage of the capacitor vary linearly and the terminal voltage of the capacitor is measured highly accurately by comparing means thereby measuring the time difference between two pulses with a high degree of accuracy.

It is a fourth object of the present invention to provide an inter-pulse time difference measuring circuit which can be easily formed in an IC and is highly accurate in operation.

It is a fifth object of the present invention to provide an inter-pulse time difference measuring circuit which employs two capacitors having a constant capacitance ratio thereby ensuring a highly accurate operation.

According to the invention, to accomplish the above objects, an inter-pulse time difference measuring circuit for measuring an inter-pulse time difference between a first pulse and a second pulse has a capacitor whose terminal voltage being set initially to a predetermined value, first control means for performing either one of charging and discharging the capacitor with a first constant current in accordance with the inter-pulse time difference, second control means for performing the other one of charging and discharging the capacitor with a second constant current whose magnitude is smaller than the magnitude of the first constant current, means for generating a reference voltage, comparing means for comparing the terminal voltage of the capacitor with the reference voltage, generating means for generating a third pulse whose pulse width corresponds to a time period derived by expanding the inter-pulse time difference with a given multiplication factor until the comparator means detects that the terminal voltage of the capacitor is substantially equal to the reference voltage while the second control means being in operation and measuring means for measuring the pulse width of the third pulse to determine the inter-pulse time difference.

DESCRIPTION OF THE PREFERRED EMBODIMENTS

A first embodiment of the present invention will now be described with reference to the drawings.

In the first embodiment, a pulse Tin is generated whose pulse width corresponds to the delay time between the emission of a pulsed laser light and the reception of its reflected light. Currents of different magnitude are used for charging and discharging a capacitor so that the required times for charging and discharging the capacitor to and from a given voltage respectively differ from each other. The pulse width of the pulse signal Tin is expanded by an arbitrarily selected constant multiplication factor which is determined by the charging/discharging time ratio of the capacitor.

Figure 1:
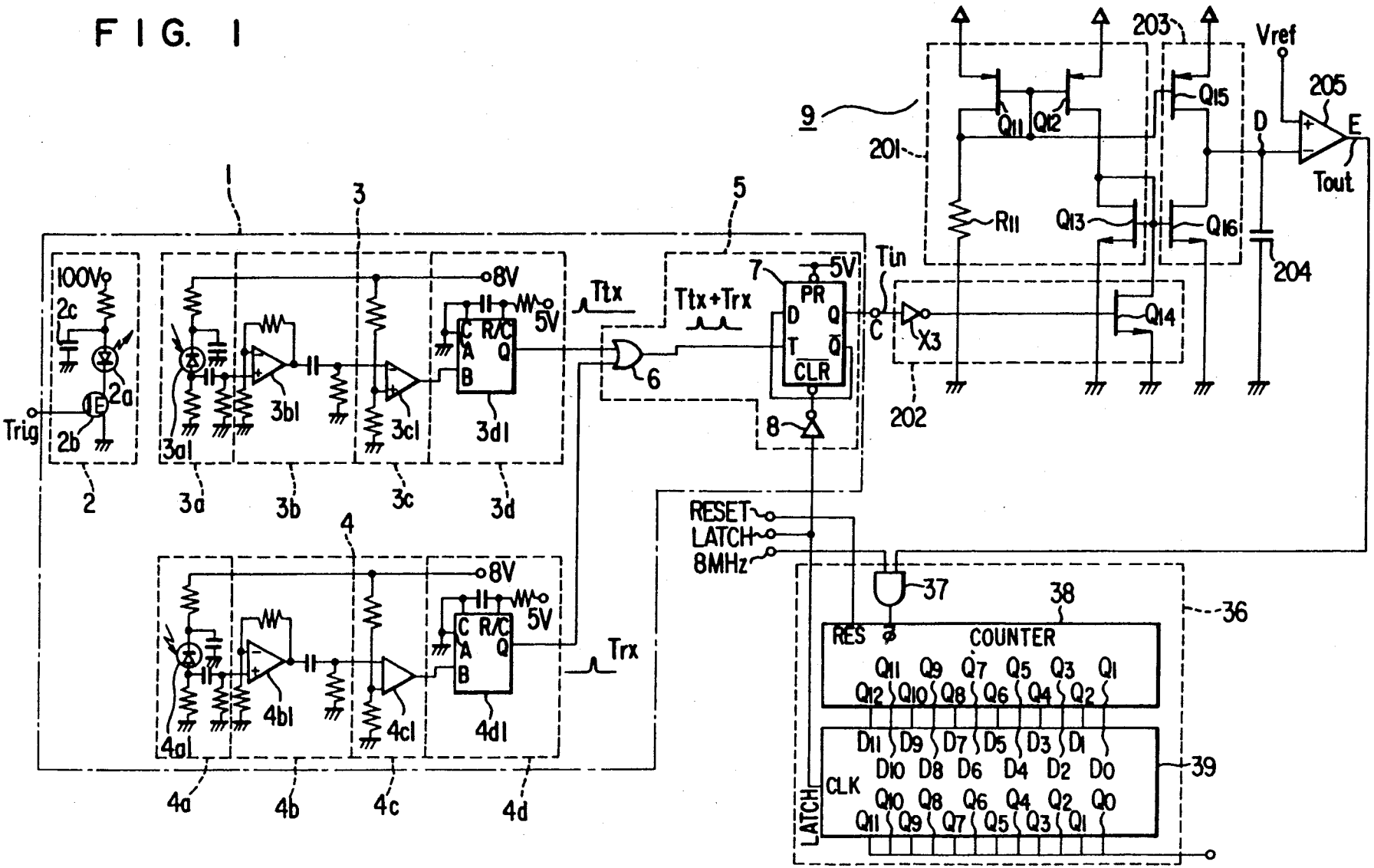
FIG. 1 is a circuit diagram showing the construction of a first embodiment of the present invention.

Referring to FIG. 1, there is illustrated the construction of the first embodiment. In the Figure, a pulse signal generating section 1 includes a light emitting unit 2 for emitting a pulse laser light, an emission detecting unit 3 for detecting the emission timing of the pulsed laser light, a reception detecting unit 4 for receiving the pulsed laser light reflected from a target to detect the reception timing, and an output unit 5 responsive to the emission timing and reception timing of the pulsed laser light to generate a pulse signal having a pulse width corresponding to the delay time between the emission and reception of the pulsed laser light.

In the light emitting unit 2, when a signal Trig goes to a high level so that a transistor **2*b* is turned on, the high-voltage charge stored in a capacitor 2*c* is supplied to a laser diode 2*a* and the laser diode 2*a*** emits a laser light.

In the emission detecting unit 3, a photodiode **3*a*, of a light receiver 3*a* directly receives the pulsed laser light emitted from the laser diode 2*a* of the light emitting unit 2. The voltage produced in the photodiode $3a_1$ by the reception of the pulsed laser light is amplified by an operational amplifier $3b_1$ of an amplifying element 3*b*. A comparing element 3*c* compares the voltage amplified by the operational amplifier $3b_1$ and a reference voltage established by two resistors so that when the amplified voltage becomes higher than the reference voltage, a comparator $3c_1$ generates a high-level signal. When the output signal of the comparator $3c_1$ goes to the high level, a monostable multivibrator $3d_1$ of a signal output element 3*d* is triggered to generate a prescribed pusle signal Ttx. In other words, the emission detecting unit 3 is constructed so that when the pulsed laser light is emitted from the laser diode 2*a* of the light emitting unit 2, the pulse signal Ttx is generated. As a result, the pulse signal Ttx is a signal indicating the emission timing of the pulsed laser light. The reception detecting unit 4 is basically the same in construction and operation as the emission detecting unit 3 except that while the emission detecting unit 3 directly receives the pulsed laser light emitted from the laser diode 2*a* to output the pulse signal Ttx, the reception detecting unit 4** receives the pulsed laser light reflected from a target to generate a pulse signal Trx.

In the output unit 5, the pulse signal Ttx generated by the emission detecting unit 3 and the pulse signal Trx generated by the reception detecting unit 4 are both applied to an OR gate 6. As a result, the pulse signal Ttx and the pulse signal Trx are successively outputted from the OR gate 6. The output of the OR gate 6 is used as clock pulses for a D-type flip-flop 7. The D-type flip-flop 7 generates from its Q terminal a pulse signal Tin which goes to the high level when the pulse signal Ttx is applied an goes to the low level when the pulse signal Trx is applied. Since the pulse signals Ttx and Trx are signals which respectively indicate the emission timing and reception timing of the pulsed laser light, the pulse signal Tin generated by the D-type flip-flop 7 has a pulse width corresponding to the delay time between the emission and the reception of the pulsed laser light.

The pulse width of the pulse signal Tin produced by the pulse signal generating section 1 is expanded with an arbitrary multiplication factor by a pulse width expansion circuit 9 in accordance with the difference between the charging and discharging times of a capacitor. A constant current generating unit 201 is formed as a well known current-mirror-connected circuit with two field effect transistors (FETs) $Q_{11}$ and $Q_{12}$ and a resistor $R_{11}$. Also, the constant current generating unit 201 includes an FET $Q_{13}$ whose drain and gate are cascade-connected to the source of the FET $Q_{12}$. The sources of the FET $Q_{11}$ and $Q_{12}$ are connected to a power source which is not shown. Also, in a charging and discharging unit 203, the source of an FET $Q_{15}$ is connected to the same power source as the FETs $Q_{11}$ and $Q_{12}$ and the gate of the FET $Q_{15}$ is connected to the resistor $R_{11}$. These FETs $Q_{11}$, $Q_{12}$ and $Q_{15}$ are P-channel FETs having the same transistor size (channel width W and channel length L). Thus, since the FETs $Q_{11}$, $Q_{12}$ and $Q_{15}$ are the same in transistor size and gate bias voltage, a current of the same magnitude flows to each of the fETs $Q_{11}$, $Q_{12}$ and $Q_{15}$. Also, in the charging and discharging unit 203, the drain of an FET $Q_{16}$ is connected to the drain of the FET $Q_{15}$ and the gate of the FET $Q_{16}$ is connected to the gate of the FET $Q_{13}$. Also, the inverting terminal of a comparator 205 and one end of a capacitor 204 are connected to the connection line connecting the drain of the FET $Q_{15}$ and the drain of the FET $Q_{16}$ in the charging and discharging unit 203. Applied to the non-inverting terminal of the comparator 205 is a reference voltage Vref set slightly lower than the voltage of the power source which is not shown. In other words, the comparator 205 compares the terminal voltage of the capacitor 204 and the reference voltage Vref so that it generates a high-level signal Tout from its output terminal E until the terminal voltage of the capacitor 204 exceeds the reference voltage Vref. The other end of the capacitor 204 is grounded. The gates of the FETs $Q_{13}$ and $Q_{16}$ are both connected to the drain of an FET $Q_{14}$ of a discharge switching unit 202 and the FET $Q_{14}$ has its gate connected to an input terminal C through an inverter $X_3$ and its source grounded. Here, the FETs $Q_{13}$, $Q_{14}$ and $Q_{16}$ are N-channel FETs and their transistor sizes are selected so that a current of the same magnitude flows to each of the FETs $Q_{11}$, $Q_{12}$ and $Q_{15}$ and a current of n times (n is an integer not less than 1) the current in the FET $Q_{13}$ flows to the FET $Q_{16}$.

Figure 2:
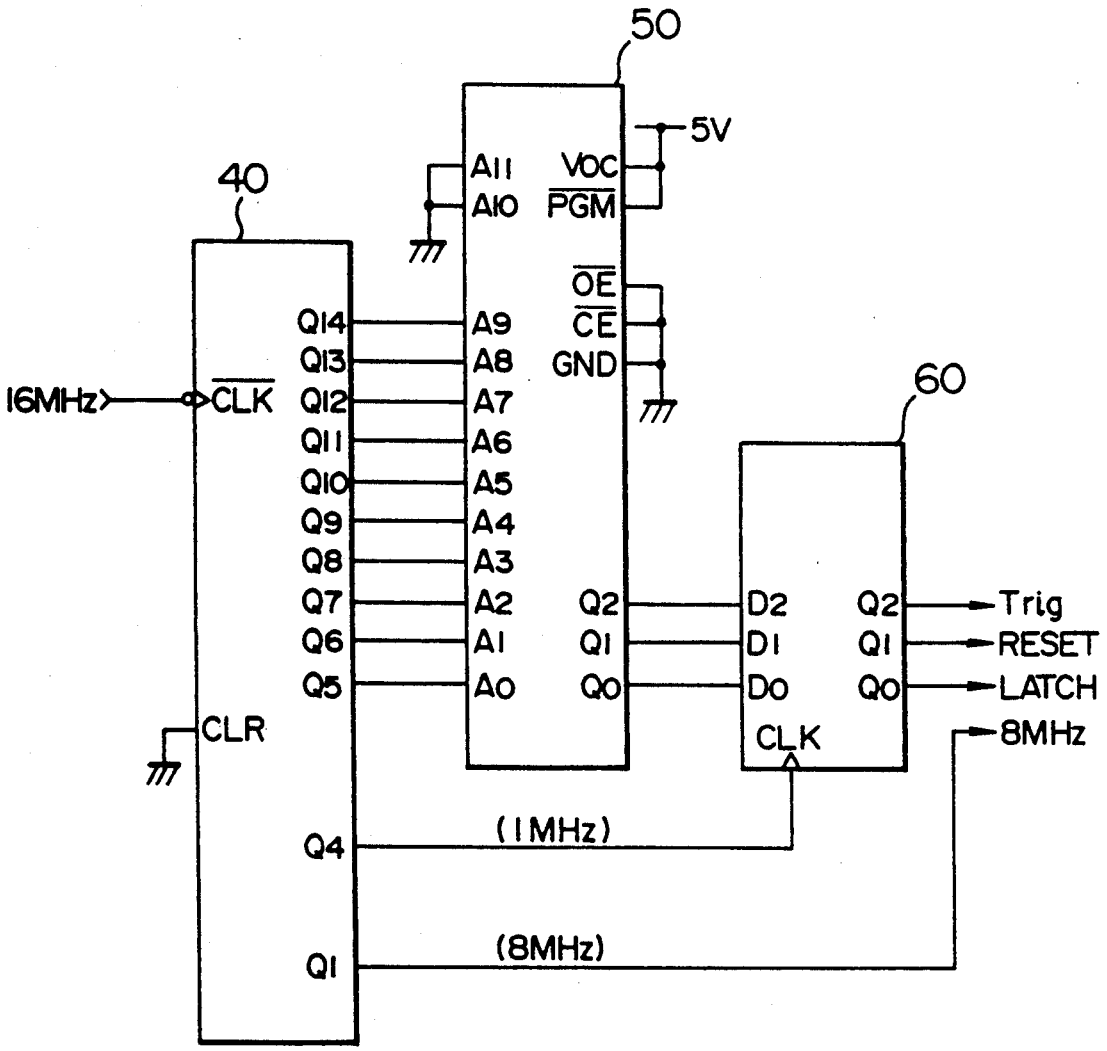
FIG. 2 is a circuit diagram of the control signal generating circuit which generates control signals for the circuitry shown in FIG. 1.
Figure 3:
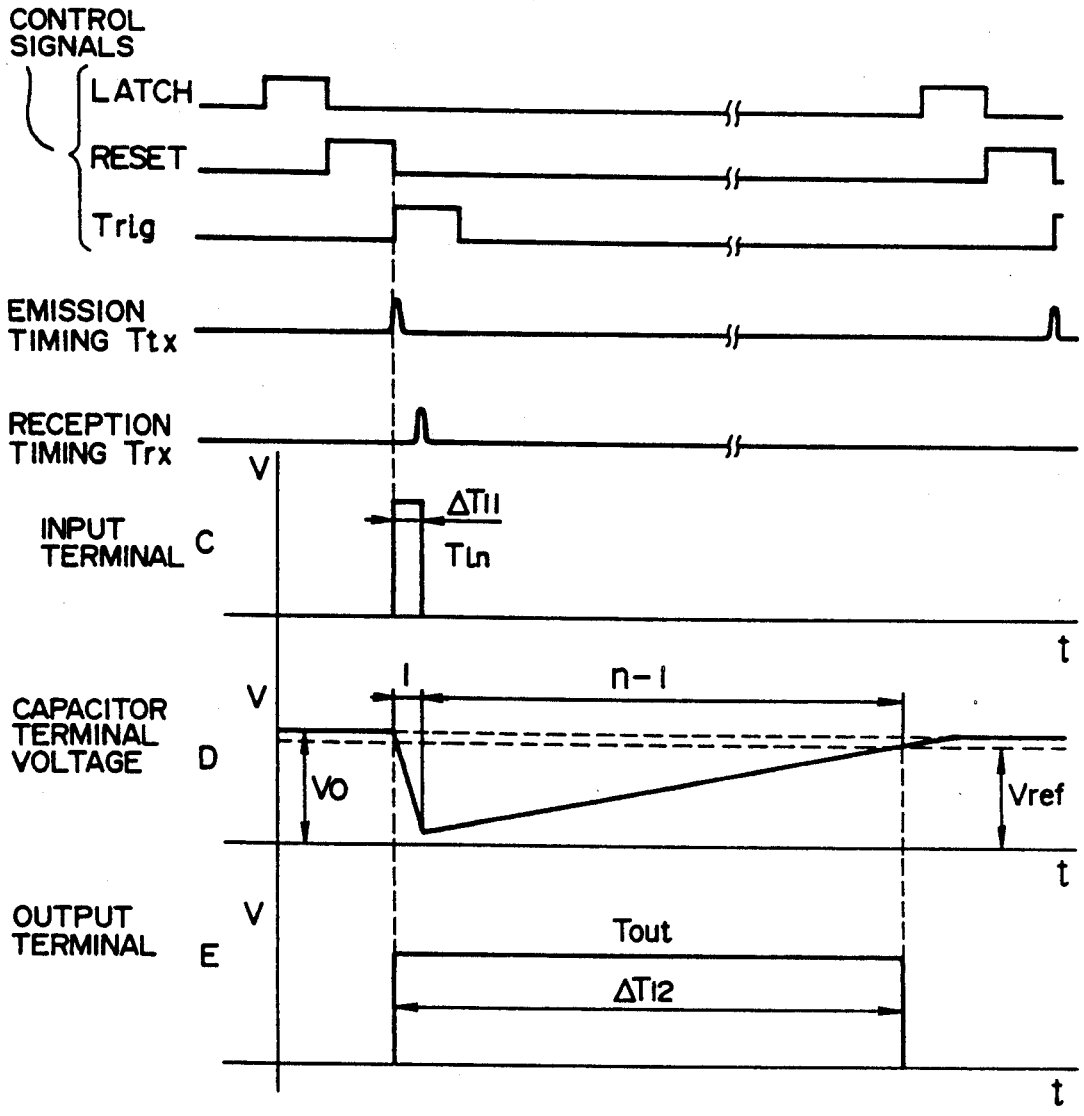
FIG. 3 is a timing chart showing the control signals and a plurality of operation waveforms generated at various points of the circuitry in FIG. 1.

A distance measuring unit 36 includes an AND gate 37 which in turn receives as one input the pulse signal Tout generated by the pulse width expansion circuit 9 and as the other input 8-MHz clock signals. As a result, clock signals whose number corresponds to the pulse width of the pulse signal Tout are outputted through the AND gate 37. The output of the AND gate 37 is applied to a counter 38 which in turn counts the number of the applied clock signals. Also, the counter 38 is reset by a reset signal RESET to return to its intial state. The nubmer of the clock signals counted by the counter 38 is stored in a latch when a latch signal LATCH is applied to it and the value stored in the latch 39 is generated as an output of the distance measuring unit 36. The control signals such as the reset signal are generated by the control signal generating circuit shown in FIG. 2. In the Figure, the control signal generating circuit includes a counte 40 which receives 16-MHz clock signals at its clock terminal and it includes 15-bit output terminals $Q_1$ to $Q_{15}$ (the terminal $Q_{15}$ is not shown in FIG. 2). Then, the counter 40 generates a pulse signal having a frequency of 8 MHz from its output terminal $Q_1$ and its higher 10-bit output terminals $Q_5$ to $Q_{14}$ are respectively connected to address terminals $A_0$ to $A_9$ of an EPROM 50. Then, the EPROM 50 is subjected to addressing by the output of the counter 40 so that the data stored in the designated address is generated from one of 3-bit output terminals $Q_0$ to $Q_2$. It is to be noted that the necessary data (or generating the respective control signals are preliminarily stored in given addresses in the EPROM 50 so that the control signals of the waveforms as shown in FIG. 3 are generated from the respective outputs $Q_0$ to $Q_2$. The 3-bit output terminals $Q_0$ to $Q_2$ of the EPROM 50 are respectively connected to input terminals $D_0$ to $D_2$ of a latch 60 and also a pulse signal having a frequency of 1 MHz and generated from the output terminal $Q_4$ of the counter 40 is applied to a clock terminal CLK of the latch 60. In this case, when the data stored in the address designated by the counter 40 is generated from the EPROM 50, the data generated from the EPROM 50 becomes unstable due to the counting of the counter 40 being continued. The latch 60 is provided to prevent such deficiency so that when the circuit of the counter 40 is completely changed over from one to another, the latch 60 stores the data just generated from the EPROM 50 thereby generating the stable data. Then, the latch signal LATCH, the reset signal RESET and the trigger signal Trig are respectively generated from the three output terminals $Q_0$ to $Q_2$ of the latch 60 and these control signals are repeatedly generated at a period of 1 kHz from the control signal generating circuit shown by FIG. 2 on the whole.

With the construction described above, the operation of the present embodiment will be described with reference to the circuit diagram of FIG. 1 and the timing chart of FIG. 3.

In FIGS. 1 and 3, the light emitting unit 2 of the pulse signal generating section 1 emits a pulsed laser light in response to the high-level of the trigger signal generated as shown in the upper part of FIG. 3 at the same time that the reset signal RESET generated from the control signal generating circuit goes to the low level. The emission timing of the pulsed laser light is detected by the emission detecting unit 3 and also the reception timing of the reflected light of the pulsed laser light is detected by the reception detecting unit 4. In response to the emission timing and the reception timing, the output unit 5 generates a pulse signal Tin having a pulse width $\Delta T_{11}$ corresponding to the delay time between the emission and the reception of the pulsed laser light.

Before the generation of the pulse signal Tin by the output unit 5, a blow-level signal is applied to the input terminal C of the inverter $X_3$ so that the FET $Q_{14}$ is turned on by the inverter $X_3$. Thus, the constant current produced by the constant current generating unit 2 flows through the FET $Q_{14}$ and the FETs $Q_{13}$ and $Q_{16}$ are maintained off. At this time, the capacitor 204 is charged by the FET $Q_{15}$ so that the terminal voltage of the capacitor 204 is increased up to an initial voltage $V_0$ by the power supply voltage (not shown) as shown in FIG. 3. When the pulse signal Tin is applied in this condition, the FET $Q_{14}$ is turned off so that the FETs $Q_{13}$ and $Q_{16}$ are turned on and the capacitor 204 is discharged through the FET $Q_{16}$. Aslo, the capacitor 204 tends to be charged through the FET $Q_{15}$ as mentioned above. Even during this discharging period of the capacitor 204, the current flows in the FETs $Q_{12}$ and $Q_{15}$, respectively, so that the currents from the FETs $Q_{12}$ and $Q_{15}$ respectively, flow along with the current from the capacitor 204, to the FETs $Q_{13}$ and $Q_{16}$. At this time, the current of the same value (the current of one time) as the FETs $Q_{12}$ and $Q_{15}$ flows to the FET $Q_{13}$ and the current of n times that of the FETs $Q_{12}$, $Q_{13}$ and $Q_{15}$ flows to the FET $Q_{16}$. As a result, during the discharging period the current of $(n-1)$ times that of the FETs $Q_{12}$, $Q_{13}$ and $Q_{15}$ flows out of the capacitor 204. When this discharge causes the terminal voltage of the capacitor 204 to become lower than the reference voltage Vref, a pulse signal Tout is generated from an output terminal E.

Then, when the pulse signal Tin again goes to the low level, the FET $Q_{14}$ is turned on so that the FETs $Q_{13}$ and $Q_{16}$ are turned off. As a result, the capacitor 204 starts to be charged with the current flowing in from the FET $Q_{15}$. At this time, the current supplied to the capacitor 204 through the FET $Q_{15}$ is $1(n-1)$ of the discharge current flown during the discharging period so that the time required for the terminal voltage of the capacitor 204 to become higher than the reference voltage Vref is $(n-1)$ times that required for the discharging. Then, when the terminal voltage of the capacitor 204 becomes higher than the reference voltage Vref, the output signal Tout of the comparator 205 goes to the low level. In other words, the time during which the pulse signal Tout generated by the comparator 205 is sustained at a high-level is $1+(n-1)$ times or n times the pulse width of the pulse signal Tin as shown in FIG. 3.

In the distance measuring unit 36, during the time determined by the pulse width $\Delta T_{12}$ of the pulse signal Tout the distance L to a target is computed in accordance with the number of clock pulses counted by the counter 38. The output from the counter 38 is stored in the latch 39 in response to the latch signal LATCH applied to the latch 39 and also the D-type flip-flop 7 of the output unit 5 is cleared by the latch signal LATCH applied via an invertor 8. Here, the relation between the distance L and the pulse width $\Delta T_{11}$ becomes as follows $$\Delta T_{11} = 2L/C \quad (1)$$

$$C = 3 \times 10^8 m\text{:light velocity}$$

The pulse width per meter of the distance L becomes $\Delta T_{11} = 6.67$ ns from equation (1). Thus, in order that a resolution of 1 m may be obtained in such cases where the delay time between the emission and reception of light is directly measured as previously, the frequency $f_o$ of clock pulses must be selected 150 MHz. In accordance with the present embodiment, however, the current ratio n between the FETs $Q_{16}$ and $Q_{13}$ is selected 75 and therefore there results a resolution of 0.25 m despite the frequency $f_o$ of clock pulses being selected 8 MHz.

It is to be noted that in the first embodiment the capacitor 204 is charged when the pulse signal Tin is not applied and the capacitor 204 is discharged when the pulse signal Tin is applied. The capacitor 204 is discharged through the N-channel FETs $Q_{13}$ and $Q_{16}$ so that where the pulse width expansion circuit of the present embodiment is integrated into ICs, there is expected the effect of reducing the overall area of the charging and discharging unit 203. The reason is that as compared with the P-channel FET, the carrier mobility in the N-channel FET is about 2.5 times and therefore a greater current can be supplied.

In the present embodiment, the output current from the constant current generating circuit 201 is determined by the resistance of the resistor $R_{11}$ and the voltage of the power source, connected to the drain and the source of FET $Q_{11}$ respectively. So, it is concidered that the output current from the constant current generating circuit 201 is varied with the variation in the resistance of the resistor $R_{11}$ and a long term variation in the voltage of the power source, both due to changes in temperature and/or any other external factors. The capacitance of the capacitor 204 is also varied due to temperature change etc., along with the output current from the constant current generating circuit 201, and therefor it is considered that the charging and discharging periods of the capacitor 204 are affected by temperature variation and/or other causes.

However, in a case where the circuitry of the pulse width expansion circuit 9 is formed in a single chip IC, the current distribution ratio n of FETs $Q_{15}$ to $Q_{16}$ can be held substantially constant, and thus an advantge is gained that the time ratio of the charging and discharging periods of the capacitor 204 hardly be affected by temperature variation and/or any other variations.

In the same way, where the circuitry is realized in an IC, even when the individual absolute values of the resistor $R_{11}$ and the capacitor 204 are varied due to any causes in the cource of manufacture of the circuitry into an IC, the output characteristic of the pulse width expansion circuit 9 (the time ratio of charging to discharging periods) remains constant throughout the actual operation.

Accordingly, this embodiment is characterized by that there is no requirement for a strict quality control on the manufacture of the circuitry, nor for adjustments thereof with adjusting registors or the like.

It is to be noted that as compared with those which do not perform the charging and discharging by using a constant current circuit, in the case of the present invention the characteristic is not varied much even if the resistance of wirings and the power supply voltage are varied locally provided that the constant current value of the constant current circuit is not varied. In addition, as shown in FIG. 3, because the capacitor terminal voltage varies linearly and not exponentially, a comparison of the terminal voltage to the reference voltage Vref can be performed with a reduced variation.

While, in the first embodiment, the capacitor 204 is discharged when the pulse signal Tin is applied, the capacitor 204 may be charged when the pulse signal Tin is applied.

A second embodiment of the present invention will now be described with reference to FIGS. 4 and 5.

The second embodiment is designed so that two capacitors of different capacitances are charged by the same constant current and the pulse width of a pulse signal is expanded with an arbitrary multiplication factor in accordance with the difference between the charging times required for the terminal voltages of the two capacitors to attain a given voltage.

With the second embodiment, its construction other than a pulse width expansion circuit is the same with the construction of the first embodiment and therefore only the pulse width expansion circuit will be described.

Figure 4:
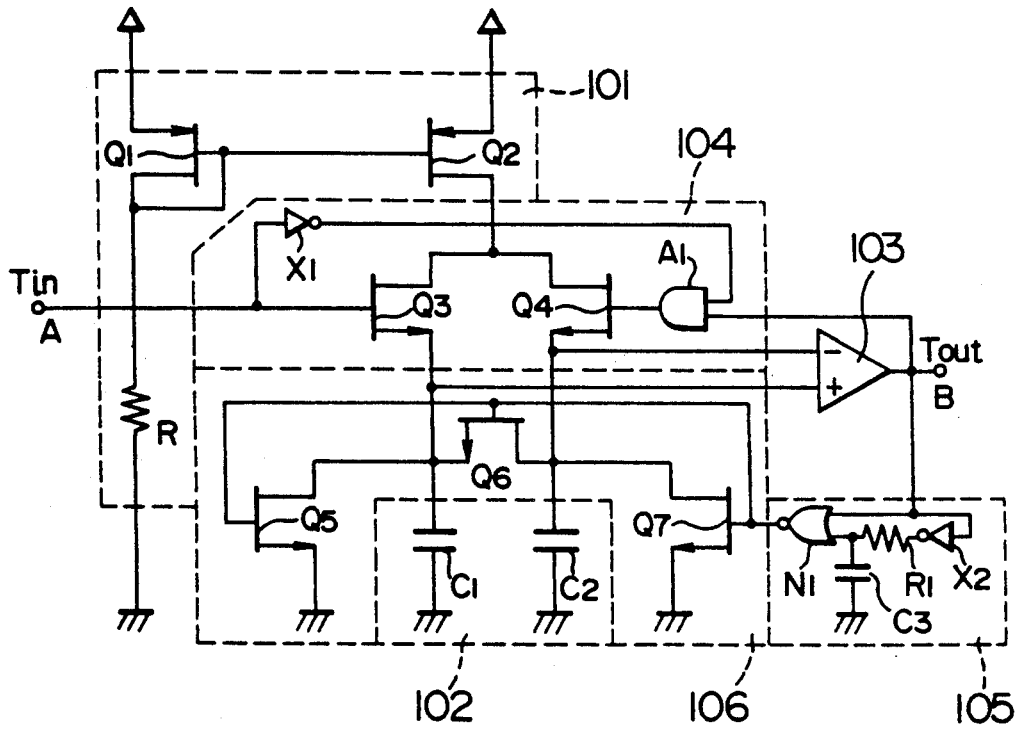
FIG. 4 is a circuit diagram showing the construction of a second embodiment of the invention.

FIG. 4 is a circuit diagram showing the construction of the pulse width expansion circuit in the second embodiment. In the Figure, a constant current generating unit 101 forms a known type of current mirror circuit with two field effect transistors (FET) $Q_1$ and $Q_2$ and a resistor R. Note that the sources of the FETs $Q_1$ and $Q_2$ are connected to a power source which is not shown. The current generated by the constant current generating unit 101 is supplied to the drawins of two FETs $Q_3$ and $Q_4$ of a charging switching unit 104. Also note that the FETs $Q_3$ and $Q_4$ are constructed to have the same current capacity. The gate of the FET $Q_3$ is connected to an input terminal A and the pulse signal Tin generated by the pulse signal generating circuit is applied to the input terminal A. Then, when the pulse signal Tin goes to the high level, the FET $Q_3$ is turned on and a reference capacitor $C_1$ is charged by the current generated by the constant current generating unit 101. On the other hand, the gate of the FET $Q_4$ is connected to the output terminal of an AND gate $A_1$. One input terminal of the AND gate $A_1$ is connected to the input terminal A through an inverter $X_1$ and the other input terminal is connected to an output terminal B. Then, when the both input signals of the AND gate $A_1$ go to the high level, the FET $Q_4$ is turned on and a comparison capacitor $C_2$ is charged by the current generated by the constant current generating unit 101. A comparator 103 compares the terminal voltage of the reference capacitor $C_1$ with the terminal voltage of the comparison capacitor $C_2$ so that a high-level signal is generated when the terminal voltage of the reference capacitor $C_1$ is higher and a low-level signal is generated when the terminal voltage of the comparison capacitor $C_2$ is higher. A discharging switching unit 106 is formed with three FETs $Q_5$, $Q_6$ and $Q_7$ and it is provided to discharge the voltages stored in the reference capacitor $C_1$ and the comparison capacitor $C_2$, respectively. An edge detecting unit 105 includes a NOR gate $N_1$ having its one input terminal connected directly to the output terminal of the comparator 103 and its other input terminal connected to the output terminal of the comparator 103 through an inverter $X_2$ and a CR circuit including a capacitor $C_3$ and a resistor $R_1$. The edge detecting unit 105 detects that the pulse signal Tout generated from the comparator 103, with an expanded pulse width, has gone to the low level. Then, upon the detection of the pulse signal Tout at the low level, a pulse signal, with a pulse width determined by the time constant of the CR circuit $C_3$ and $R_1$, is applied to each of the FETs $Q_5$, $Q_6$ and $Q_7$ in the discharging switching unit 106.

With the construction described above, the operation of the pulse width expansion circuit will be described with reference to the circuit diagram of FIG. 4 and the timing chart of FIG. 5.

Figure 5:
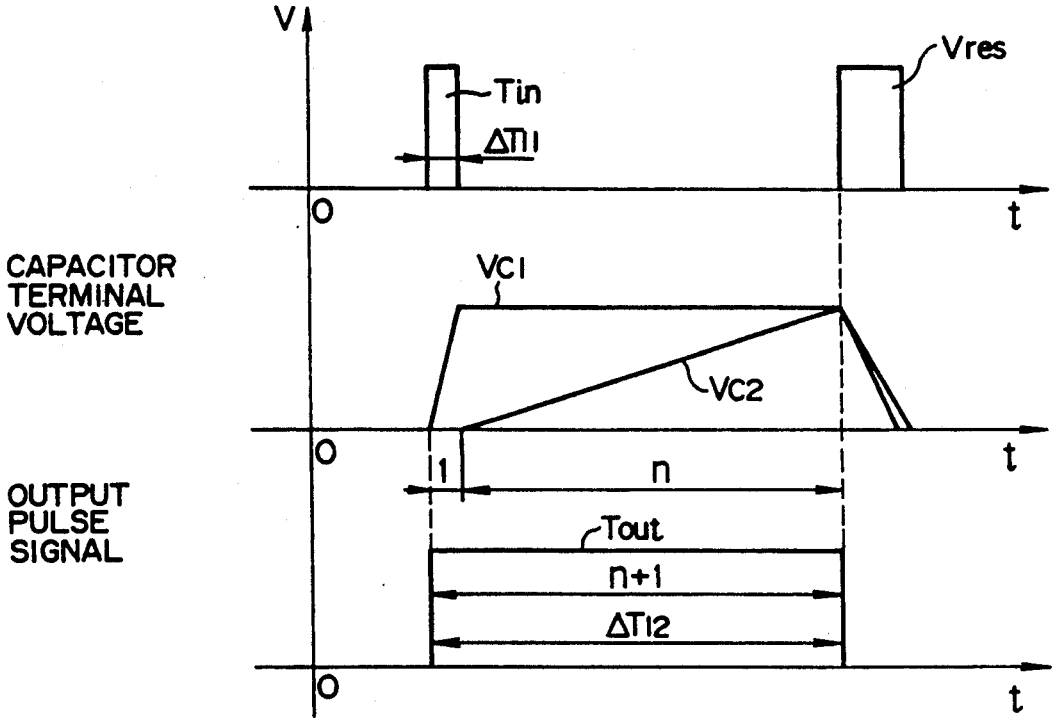
FIG. 5 is a timing chart for explaining the operation of the second embodiment of the invention.

In the FIGS. 4 and 5, when the pulse signal Tin is at the low level, the two FETs $Q_3$ and $Q_4$ in the charging switching unit 104 are both off and thus the both terminal voltages $V_{c1}$ and $V_{c2}$ of the reference and comparison capacitors $C_1$ and $C_2$ are reduced to substantially zero.

In this condition, when the pulse signal Tin shown in FIG. 5 is applied to the input terminal A, the FET $Q_3$ is turned on and the reference capacitor $C_1$ is charged with the current from the constant current generating unit 101. As the result of this charging, the terminal voltage $Vc_1$ of the reference capacitor $C_1$ is increased and thus the comparator 103 generates a high-level signal Tout. The charging of the reference capacitor $C_1$ is continued so far as the pulse signal Tin remains at the high level and the charging is terminated as soon as the pulse signal Tin goes to the low level. In other words, the terminal voltage $Vc_1$ of the reference capacitor $C_1$ has a value proportional to the pulse width $\Delta T_{11}$ of the pulse signal Tin.

Then, when the pulse signal Tin goes to the low level, the FET $Q_3$ is turned off and the AND gate $A_1$ is caused by the inverter $X_1$ to generate a high-level signal and to thereby turn the FET $Q_4$ on. When this occurs, with the terminal voltage $Vc_1$ of the reference capacitor $C_1$ being maintained at the charged potential, the comparison capacitor $C_2$ starts to be charged with the same current as the one which charged the reference capacitor $C_1$. This charging the comparison capacitor $C_2$ is continued until the terminal voltage $Vc_2$ of the comparison capacitor $C_2$ becomes higher than the terminal voltage $Vc_1$ of the reference capacitor $C_1$ and the comparator 103 generates a low-level signal. In the present embodiment, it is selected so that the ratio of the capacitance $C_{11}$ of the reference capacitor $C_1$ to the capacitance $C_{22}$ of the comparison capacitor $C_2$ of $C_{11}$:$C_{22}$ is 1:n. As a result, when the capacitors $C_1$ and $C_2$ are each charged with the same constant current, the comparison capacitor $C_2$ requires a time which is n times that of the reference capacitor $C_1$ until the terminal voltages $Vc_1$ and $Vc_2$ of the capacitors $C_1$ and $C_2$ attain the same voltage. The present embodiment is constructed so that the comparator 103 generates a pulse signal Tout at the same time when the charging of the reference capacitor $C_1$ is started and the charging of the comparison capacitor $C_2$ is started at the same time when the charging of the reference capacitor $C_1$ is terminated. Also, it is constructed so that the generation of the pulse signal Tout is terminated at the same time when the terminal voltage $Vc_2$ of the comparison capacitor $C_2$ becomes substantially equal to the terminal voltage $Vc_1$ of the reference capacitor $C_1$. As a result, the pulse width $\Delta T_{12}$ of the pulse signal Tout generated from the output terminal B is related to the pulse width $\Delta T_{11}$ of the pulse signal Tin applied through the input terminal A as indicated by the following expression $$\frac{\Delta T_{12}}{\Delta T_{11}} = \frac{n+1}{1} = n+1 \qquad (2)$$

When the pulse signal Tout generated from the comparator 103 goes to the low level, the edge detecting unit 105 generates a pulse signal Vres having a pulse width corresponding to the time constant of the capacitor $C_3$ and the resistor $R_1$. The pulse signal Vres is applied to the gate of each of the FETs $Q_5$, $Q_6$ and $Q_7$ in the discharging switching unit 106 and each of the FETs $Q_5$, $Q_6$ and $Q_7$ is turned on. As a result, the capacitors $C_1$ and $C_2$ are discharged through the FETs $Q_5$, $Q_6$ and $Q_7$ and the terminal voltages $Vc_1$ and $Vc_2$ of the capacitors $C_1$ and $C_2$ are reduced to substantially zero. It is to be noted that in the present embodiment the provision of the FET $Q_6$ has the effect of making the terminal voltages $Vc_1$ and $Vc_2$ of the discharged reference capacitor $C_1$ and comparison capacitor $C_2$ substantially equal to each other and thereby reducing the error due to the difference between the voltages after the discharge.

Further, where the circuitry is realized in an IC, even when the individual absolute values of the resistor $R_{11}$ and the capacitor $C_1$ and $C_2$ are varied due to any causes in the cource of manufacture of the circuitry into an IC, the capacitance ratio n of the capacitors $C_1$ to $C_2$, or the multiplication factor in the output pulse width, remains constant throughout the actual operation, because the capacitance ratio n is determined at the designing stage of the IC.

Accordingly, this embodiment is characterised by that there is no requirement for a strict quality control on the manufacture of the circuitry, nor for adjustments thereof with adjusting registors or the like.

While, in the present embodiment, the pulse width is expanded in accordance with the difference between the charging times required for charging the two capacitors to the desired voltage, it is possible to construct so that the two capacitors discharge the same voltage and the pulse width is expanded in accordance with the difference between the discharging times.

Also, it is possible to construct so that currents of different values flow to the two capacitors having the same capacitance to change the rates of change of the voltages $Vc_1$ and $Vc_2$ as shown in FIG. 5. In this case, it is only necessary to change the values of the currents flowing to the FETs $Q_3$ and $Q_4$.

Further, while, in the above-described embodiments, the field-effect transistors are used, in consideration of the easiness of manufacture it is desirable that they are of the MOS type and are mounted in a bingle chip IC, along with other cirtuitries like the counter 38 of FIG. 1. These transistors may also be constructed as of bipolar type.

We claim:

1. An inter-pulse time difference measuring circuit for measuring an inter-pulse time difference between a first pulse and a second pulse, said circuit comprising:

a capacitor whose terminal voltage is set initially to a predetermined value;

first control means for performing either one of charging and discharging the capacitor with a first constant current in accordance with said inter-pulse time difference;

second control means for performing the other one of charging and discharging the capacitor with a second constant current whose magnitude is smaller than the magnitude of the first constant current;

means for generating a reference voltage;

comparing means for comparing the terminal voltage of the capacitor with the reference voltage;

generating means for generating a third pulse whose pulse width corresponds to a time period derived by expanding said inter-pulse time difference with a given multiplication factor until the comparator means detects that the terminal voltage of the capacitor is substantially equal to the reference voltage while the second control means is in operation; and, measuring means for measuring the pulse width of the third pulse to determine said inter-pulse time difference.

2. A circuit according to claim 1, wherein the first control means includes a first transistor for supplying the first constant current to the capacitor, and wherein the second control means includes a second transistor for supplying the second constant current to the capacitor, the magnitude of the second constant current being 1/nth times the magnitude of the first constant current wherein n is an integer not less than one.

3. A circuit according to claim 2, wherein the first and second transistors are operatively connected to a third transistor which forms a constant current path, whereby the first and second transistors are controlled by the constant current flowing through the third transistor to cause the first and second transistors to flow the first and second constant current respectively.

4. A circuit according to claim 1, wherein the second control means performs in a steady-state manner either one of charging and discharging the capacitor with the second constant current until the terminal voltage of the capacitor attains a predetermined value independently from said inter-pulse time difference, and wherein the first control means performs another one of charging and discharging the capacitor with the first constant current for a time period corresponding to said inter-pulse time difference.

5. A circuit according to claim 3, wherein the operative connection connects the first and second transistor in cascade and in current-mirror connection respectively to the third transistor.

6. A circuit according to claim 2, wherein the first and second transistors are formed in a single chip IC.

7. An inter-pulse time difference measuring circuit for measuring an inter-pulse time difference between a first pulse and a second pulse, said circuit comprising:

a first capacitor whose terminal voltage is initially set to a first predetermined value;

a second capacitor whose terminal voltage is initially set to a second predetermined value;

a first control means for performing either of charging and discharging the first capacitor with a first constant current in accordance with said inter-pulse time difference;

second control means for performing the same either one of charging and discharging the second capacitor with a second constant current as performed by the first control means;

comparator means for comparing the terminal voltage of the first capacitor with the terminal voltage of the second capacitor;

generating means for generating a third pulse whose pulse width corresponds to a time period derived by expanding said inter-pulse time difference with a given multiplication factor until the comparator means detects that the terminal voltage of the second capacitor is substantially equal to the terminal voltage of the first capacitor while the second control means is in operation; and measuring means for measuring the pulse width of the third pulse to determine said inter-pulse time difference.

8. A circuit according to claim 7, wherein the first control means includes a first transistor for supplying the first constant current to the first capacitor, and wherein the second control means includes a second transistor for supplying the second constant current to the second capacitor, the magnitude of the second constant current being 1/n (n is an integer not less than one (1)) times the magnitude of the first constant current.

9. A circuit according to claim 8, wherein the first and second transistors are operatively connected to a third transistor which forms a constant current path, whereby the first and second transistors are controlled by the constant current flowing through the third transistor to cause the first and second transistors to flow the first and second constant current respectively.

10. A circuit according to claim 7, wherein the second control means performs in a steady-state manner either one of charging and discharging the second capacitor with the second constant current until the terminal voltage of the second capacitor attains a predetermined value independently from said inter-pulse time difference, and wherein the first control means performs either one of charging and discharging the first capacitor with the first constant current for a time period corresponding to said inter-pulse time difference.

11. A circuit according to claim 9, wherein the operative connection is characterized by connecting the first and second transistors in cascade and current-mirror connection respectively, to the third transistor.

12. A circuit according to claim 7, wherein the first and second transistors are formed in a single chip IC.

13. A circuit according to claim 7, wherein the first and second capacitors are formed in a single chip IC, whereby the ratio of capacitance of the capacitors is held constant.

* * * * *